US005533724A

United States Patent [19]

Choi

[11] Patent Number: 5,533,724

[45] Date of Patent: Jul. 9, 1996

[54] SPORT RACKETS

[75] Inventor: Chung-Hing Choi, Hong Kong, Hong Kong

[73] Assignee: Hing Fat Toys Manufacturer Limited, Hong Kong

[21] Appl. No.: 276,241

[22] Filed: Jul. 18, 1994

[51] Int. Cl.[6] ..... A63B 49/02

[52] U.S. Cl. ..... 273/73 C; 273/73 R; 273/73 L

[58] Field of Search ..... 273/73 R, 73 C, 273/73 L, 67 R

[56] References Cited

U.S. PATENT DOCUMENTS 3,820,785 6/1974 Occhipinti et al. ..... 273/73 R X 4,804,183 2/1989 Doran et al. ..... 273/73 L X 5,074,554 12/1991 Ramon, Jr. ..... 273/73 C X

FOREIGN PATENT DOCUMENTS 427522 5/1991 European Pat. Off. ..... 273/67 R

*Primary Examiner*—Raleigh W. Chiu

*Attorney, Agent, or Firm*—Samuels, Gauthier & Stevens

[57] ABSTRACT

A sports racket has a handle 10 and two different playing surfaces 11 and 12. The same racket can therefore be conveniently used for different sports or recreations, or used for different purposes or different scoring in a single recreation.

9 Claims, 5 Drawing Sheets

SPORT RACKETS

BACKGROUND OF THE INVENTION

1. Field of the Invention

The invention relates to sports rackets.

2. Description of prior art:

Rackets are currently provided for different functions or sports and each provided with a hand holdable shaft having a longitudinal axis. The head or frame of each racket are generally circular and arranged with centre of the circle on the longitudinal axis. It is quite common and currently a requirement that a sportsman will have several rackets, one for each different sport or recreation but the handles are usually the same or generally the same for each racket. If the sportsman intends to play more than one sport, he must have two or more rackets. The leads to double or more of expense and similar extra storage and transport space.

SUMMARY OF THE INVENTION

It is an object of the invention to overcome or at least reduce this problem.

According to the invention there is provided a sports racket having a hand holdable shaft with a longitudinal axis, and two different generally circular playing surfaces arranged to be fixed edge to edge with their centres in line with the longitudinal axis.

The racket may have an integral frame which extends from the shaft and around the two playing surfaces.

The racket may have separate frames for each of the playing surfaces which are permanently fixed together.

The racket may have separate frames for each of the playing surfaces which are releasably fixed together. The frames are arranged to be fixed together with the one playing surface covering the other playing surface.

At least one of the playing surfaces is preferably transparent. At least one of the playing surfaces may be formed of tensioned strings. At least one of the playing surfaces may be formed by an apertured panel. The panel preferably has a solid central region.

BRIEF DESCRIPTION OF DRAWINGS

A sports racket according to the invention will now be described by way of example with reference to the accompanying drawings in which.

DESCRIPTION OF THE PREFERRED EMBODIMENTS

Figure 2:
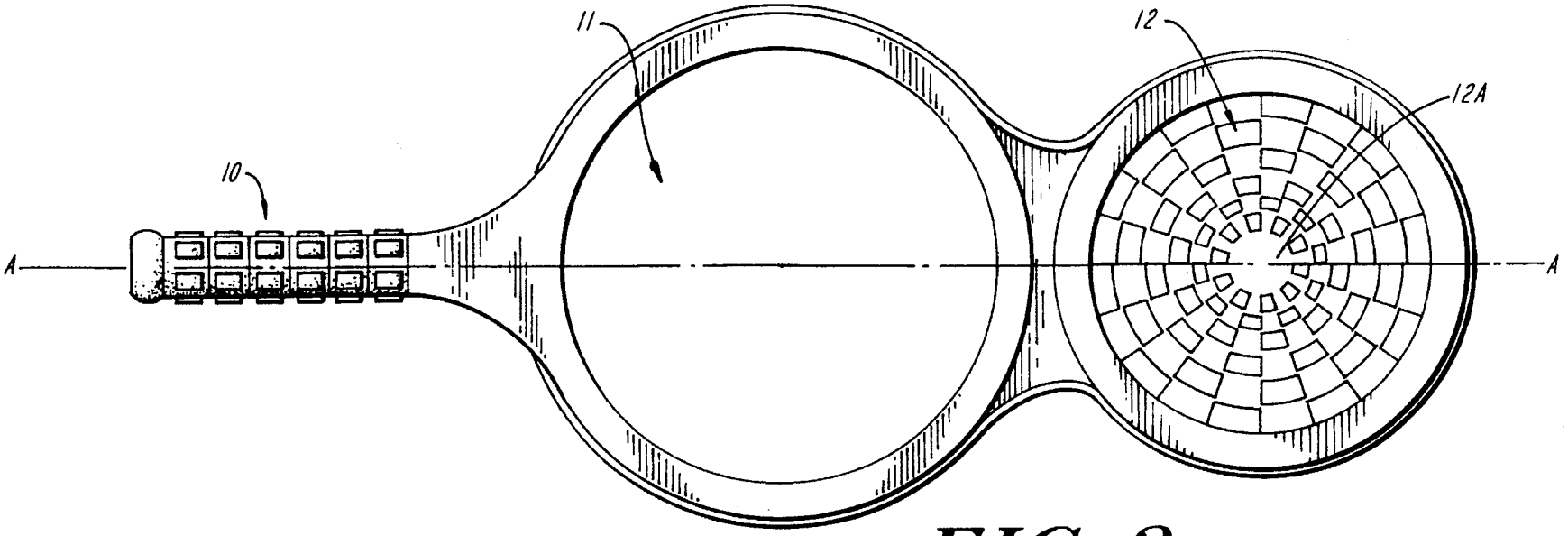
FIG. 2 is a plan view of the racket.
Figure 3:
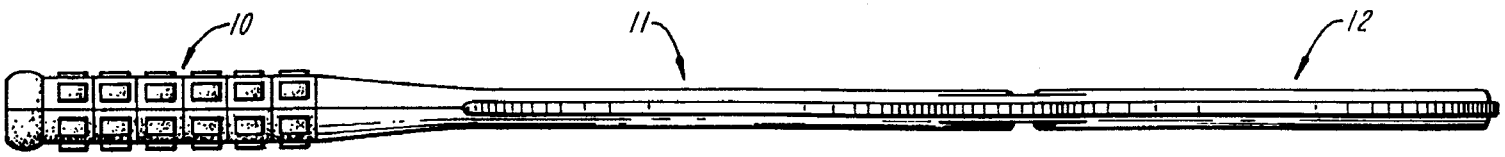
FIG. 3 is a side view of the racket.
Figure 4:
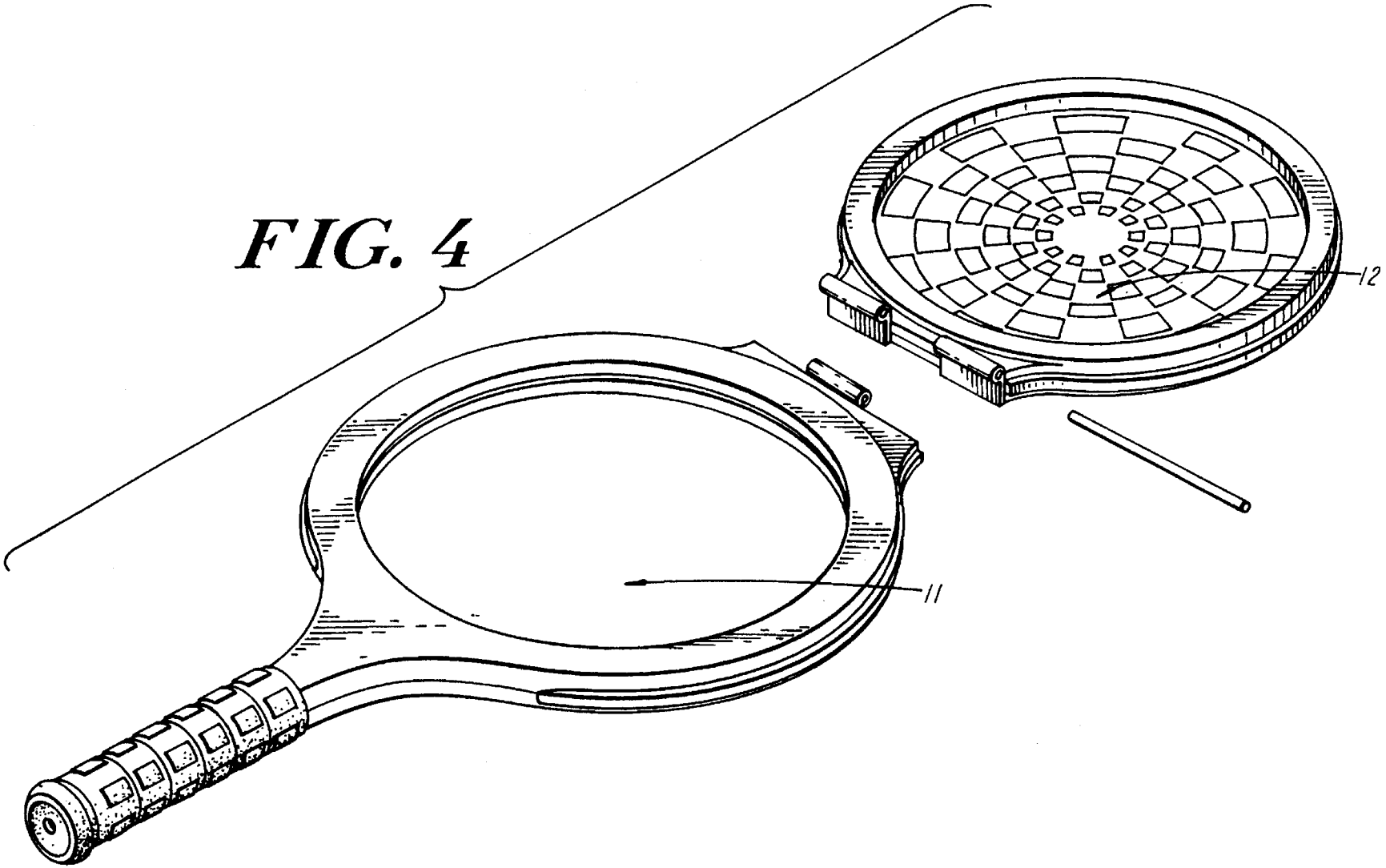
FIG. 4 is an isometric view of an alternative embodiment of the racket.
Figure 5:
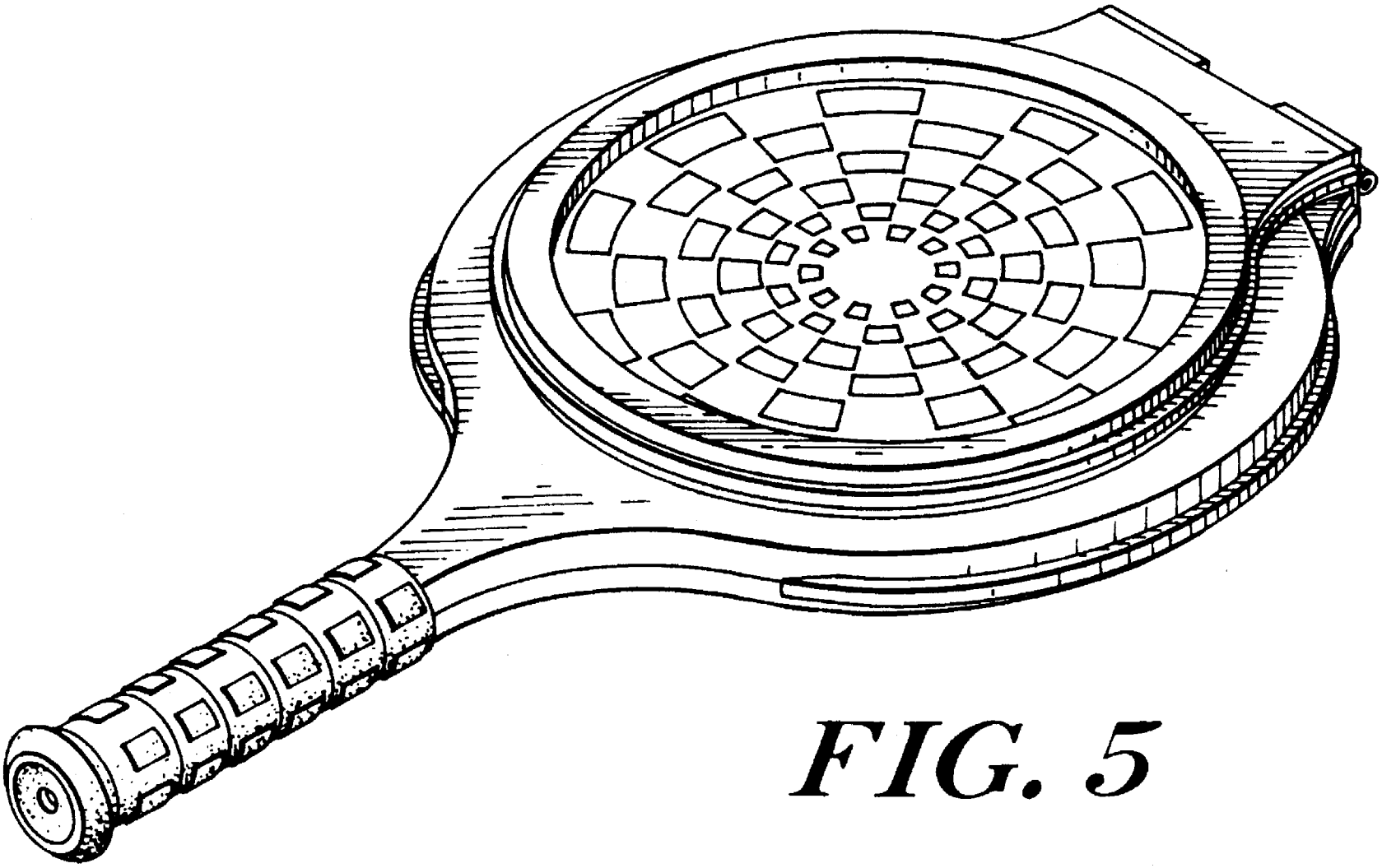
FIG. 5 is an isometric view of the racket showing the top portion of the racket folded onto the bottom portion of the same.
Figure 6:
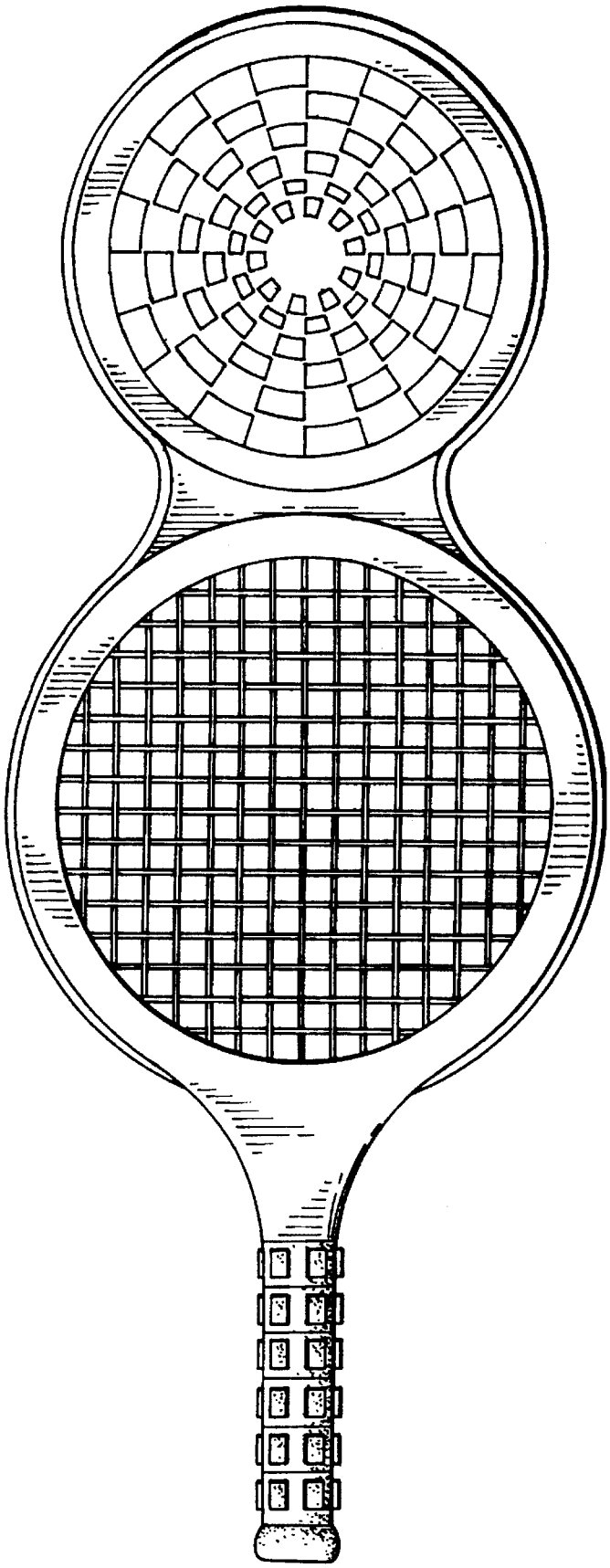
FIG. 6 is an isometric view of an alternative embodiment thereof.

Referring to the drawings, the racket has a hand holdable shaft 10 with a longitudinal central axis shown as A—A in FIG. 2. Two circular playing surfaces 11 and 12 are provided and supported by an integral frame so that the playing surfaces are fixed or supported edge to edge each with their centres on the longitudinal axis. The playing surfaces may be provided in any suitable form such as by rigid or flexible solid panels, tensioned strings and so on. The surface 12 in this embodiment is formed by an apertured panel with a solid central region 12A.

It is preferable that the playing surface 11 is transparent, which could include for a practical purposes a stringed surface. If the surface is not transparent then some loss of view of an object to be hit during play when using the surface 12 may spoil the accuracy of striking the subject.

Generally stated, embodiments of the invention will be most often provided for casual games or recreation on the beach for example where fine balance and calibration of the racket may be less important than the convenience of being able to play with different objects. For example, a soft toy ball may be used together with the surface 11 and a more robust ball used together with the surface 12. Also, games may be played and the striker differently rewarded or handicapped, to even out the relative skills of the players, according to which surface he uses or is allowed to use in a contest.

The racket frame may be made in two parts and arranged to be releasably joined together. This allows the racket to be more efficiently stored or transported. It is also possible to arrange for the two parts to fit together so that the surface 12 covers the surface 11. This could provide a playing surface that combined a solid or apertured panel and strings, say, so that the racket could be switched, that is turned over, to strike a ball either with the strings or the solid panel to give a different acceleration or flight to the ball being struck with same or different shots at the choice of the striker.

Further, the racket may be used with the playing surface (and frame part) removed, for say hand-ball. The same racket could be used with the surface 12 attached, in the configuration as shown in the drawings, in which case the surface 12, then stringed, would be used for striking a tennis ball.

Figure 1:
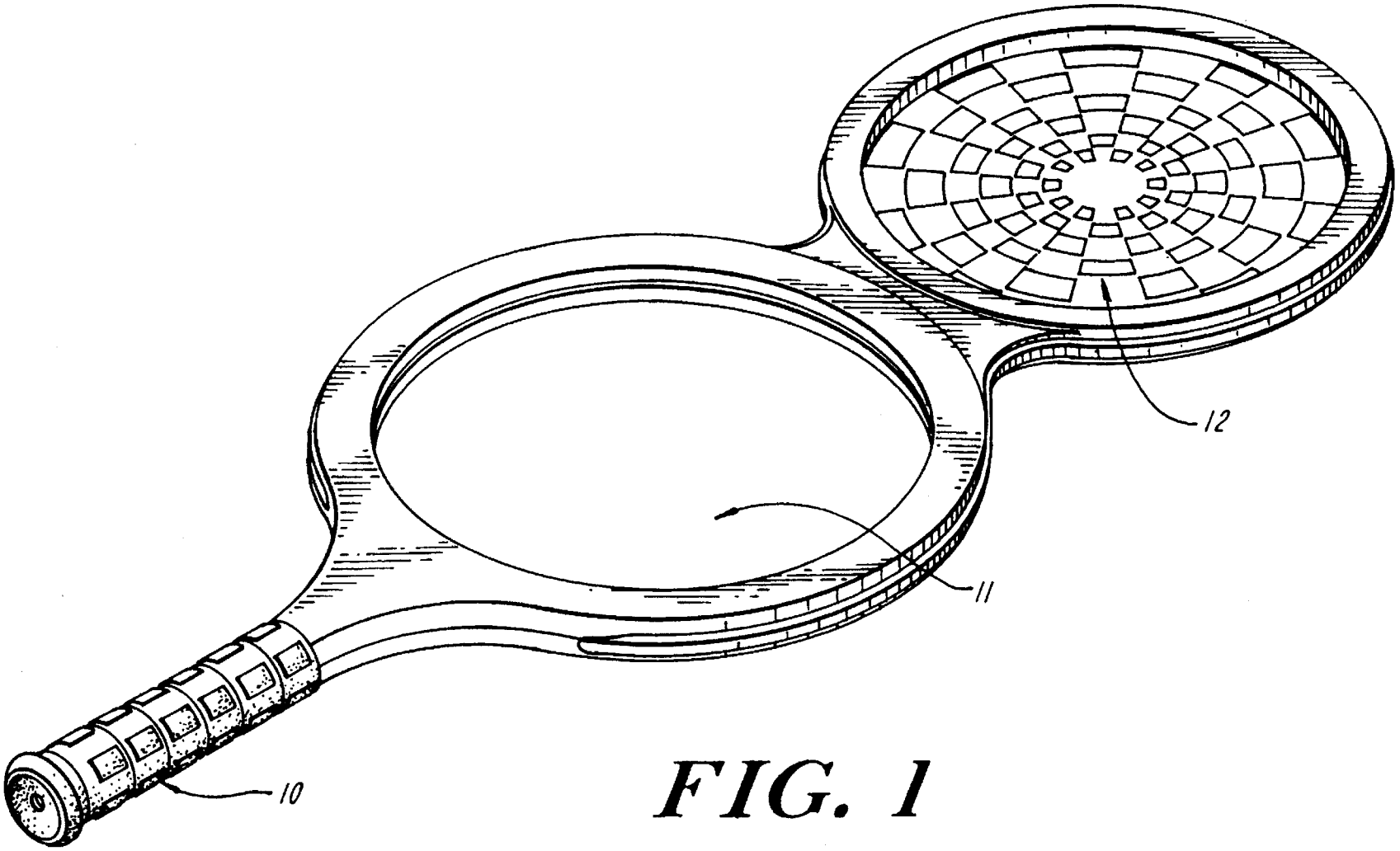
FIG. 1 is an isometric top view of the racket.

In any event, embodiments of the invent ion provide a single racket which can be used for more than one sport or recreation. This leads to a saving in cost and convenience for storage. Further, the two surfaces 11 and 12 may be used in combination either as shown in FIG. 1, say, or in an overlaying configuration. When the frame is formed in two parts, the overall size (i.e. length) of the racket can be significantly reduced by folding the surface 12 over the surface 11 where the two parts are hinged together or by removing the part with the surface 12 when they are releasably detachable from one another. As the same shaft is used for each configuration or each activity, there is not only an inherent saving in costs but the user can adapt or choose where preferred a particular form and size of grip on the shaft for his own preference.

It will be appreciated that the playing surfaces can not only be different in terms of their strength and performance but also different sizes. Also, the surfaces are normally circular or generally circular but it is intended that "generally circular" includes other shapes particularly elliptical shapes, known per se, in normal sports rackets.

I claim:

1. A sports racket having a hand holdable shaft with a longitudinal axis, and two different generally circular playing surfaces, each playing surface having a top and bottom edge, wherein the top edge of one playing surface is adjacent to the bottom edge of the second playing surface and with their centres in line with the longitudinal axis.

2. A sports racket according to claim 1 having an integral frame which extends from the shaft and around the two playing surfaces.

3. A sports racket according to claim 1, including separate frames for each of the playing surfaces which are permanently fixed together.

4. A sports racket according to claim 1, including separate frames for each of the playing surfaces which are releasably fixed together.

5. A sports racket according to claim 4, in which the frames are arranged to be fixed together with the one playing surface covering the other playing surface.

6. A sports racket according to claim 1, in which at least one of the playing surfaces is transparent.

7. A sports racket according to claim 1, in which at least one of the playing surfaces is formed of tensioned strings.

8. A sports racket according to claim 1, in which at least one of the playing surfaces is formed by an apertured panel.

9. A sports racket according to claim 8, in which the panel has a solid central region.

* * * * *